United States Patent [19]

Hanyu et al.

[11] 4,436,042

[45] Mar. 13, 1984

[54] DUAL FUNCTION SEWING MACHINE WITH A ROTATABLE BASE

[75] Inventors: Susumu Hanyu; Yoshikazu Ebata, both of Tokyo, Japan

[73] Assignee: Janome Sewing Machine Co. Ltd., Kyobashi, Japan

[21] Appl. No.: 408,658

[22] Filed: Aug. 16, 1982

[30] Foreign Application Priority Data

Aug. 31, 1981 [JP] Japan ..... 56-135436

[51] Int. Cl.[3] ..... D05B 75/06

[52] U.S. Cl. ..... 112/217.1; 248/349; 248/664

[58] Field of Search ..... 112/217.1, 258, 168; 248/349, 667, 664

[56] References Cited

U.S. PATENT DOCUMENTS 2,671,631 3/1954 Fox ..... 248/349

FOREIGN PATENT DOCUMENTS 2722205 11/1978 Fed. Rep. of Germany ... 112/217.1

2901139 12/1979 Fed. Rep. of Germany ..... 112/168

*Primary Examiner*—Werner H. Schroeder
*Assistant Examiner*—Andrew M. Falik
*Attorney, Agent, or Firm*—Michael J. Striker

[57] ABSTRACT

A rotation switching device for a sewing machine having a lock stitching mechanism and an overlock stitching mechanism. The device includes a rotatable operating member and a base disc connected to the operating member and movable in a vertical direction upon rotation of the operating member between a rest position in which the base disc is above the machine mounting surface and an operating position in which the base disc projects downward farther than the feet on the lower face of the machine body. In this position the base disc contacts the machine mounting surface to lift the body of the sewing machine from the mounting surface, whereby the body of the sewing machine may be rotated in a horizontal plane to place either the lock stitching mechanism or the overlock stitching mechanism to a use position.

7 Claims, 14 Drawing Figures

DUAL FUNCTION SEWING MACHINE WITH A ROTATABLE BASE

BACKGROUND OF THE INVENTION

This invention relates to a rotation switching device of a double-function sewing machine, which serves for switching by rotation a machine body of the sewing machine, which is incorporated with two different stitch forming mechanisms, to an operative position of the particular stitching function of either of the mechanisms.

The double-function sewing machine is disposed with needle dropping positions of a lock stitch and an overlock stitch at a right and a left, or a front and a rear in order not to interfere with the stitching operation of each other.

When the lock stitch is switched to the overlock stitch or vice versa, the operator lifts up the sewing machine which is heavy in weight from a machine positioning and mounting surface and rotates it horizontally, for working convenience. Since this work is troublesome due to carrying of the heavy load, it has been desired to solve these problems.

SUMMARY OF THE INVENTION

Therefore, it is an object of the invention to slightly lift a machine body from the said positioning surface by external and light operation, rotate it horizontally, and move it down by reverse operation and position it on the mounting surface by means of support feet in order to properly position the desired stitch forming mechanism.

These and other objects of the invention are attained by a double-function sewing machine comprising a machine body, a lock stitching mechanism and an overlock stitching mechanism positioned at two opposite sides of the machine body, and feet positioned on a lower surface of the machine body and abutting against a machine mounting surface on which the machine is positioned. A switching device is incorporated for switching the positions of the lock stitching mechanism and the overlock stitching mechanism, which includes rotating switching means disposed on the lower surface of the machine body and including a rotatable operating member, a base disc operatively connected to the operating member and adapted to move in a vertical direction with respect to said lower surface upon rotation of the operating member between a rest position in which said base disc is above the machine mounting surface and an operating position in which the base disc projects downward farther than the feet to contact said machine mounting surface, whereby the machine body is lifted from the machine mounting surface and may be rotated in a horizontal plane to place a required one of the stitching mechanisms to a use position.

The present invention will be explained in reference to the attached drawing.

DETAILED DESCRIPTION OF THE PREFERRED EMBODIMENTS

Figure 1:
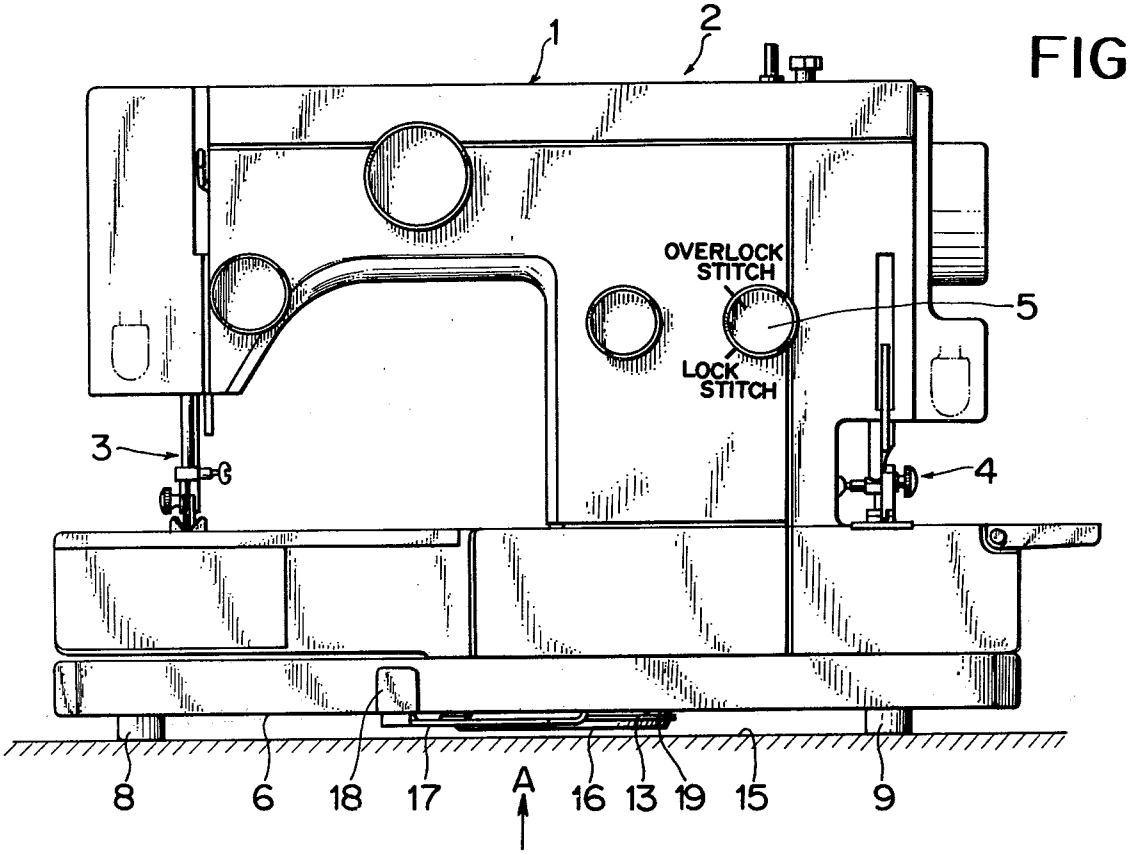
FIG. 1 is a side view showing a double-function sewing machine incorporating the device of the invention.

The attached drawings illustrate an embodiment of the invention. In FIG. 1, the reference numeral 1 is a machine body of a double-function sewing machine 2, the numeral 3 is a stitching part of the lock stitch forming mechanism (called as "lock stitch mechanism"), and 4 is an overlock stitch forming mechanism (called an "overlock stitch mechanism"). These stitch mechanisms are alternatively selected and driven by switching a dial 5.

Figure 2:
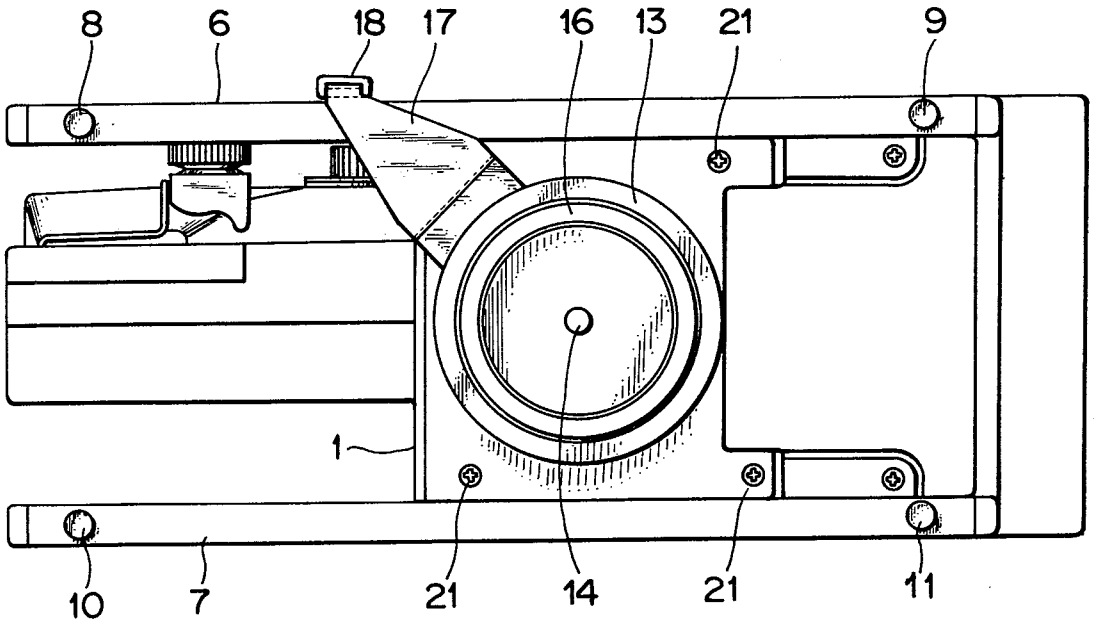
FIG. 2 is a view seen from arrow A in FIG. 1.

Referring to FIG. 2, there are, under the lower part of the machine body 1, a pair of base tubular members 6 and 7 at the front and rear sides thereof, which are provided with support feet 8, 9, 10 and 11, comprising an elastic material at lower parts thereof.

Figure 3:
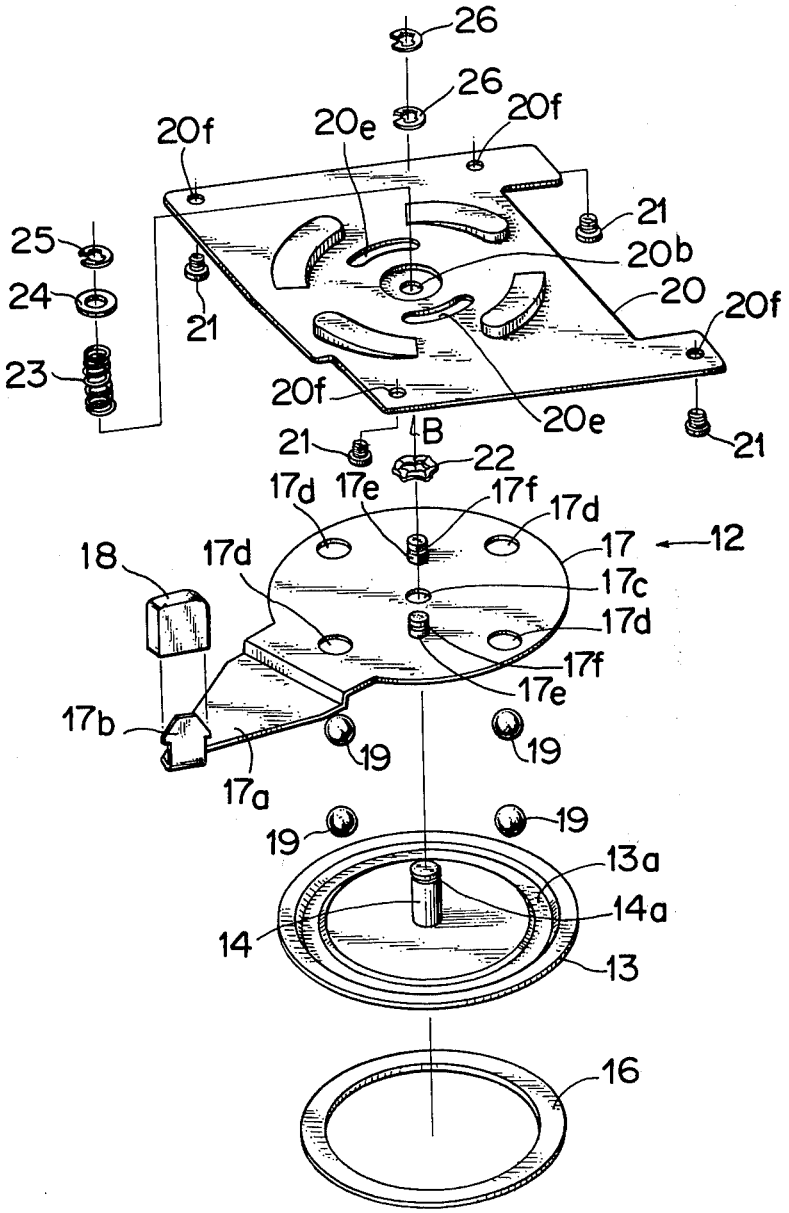
FIG. 3 is an exploded view of the device according to the invention.

On the lower part of the machine body 1, a rotation switching device 12 is disposed. The device 12 will be explained with respect to the main parts thereof in reference to FIG. 3. A base disc 13 is defined with a ring groove 13*a* and is implanted at its center with a pin 14 having a groove 14*a* at an upper portion. A sheet disc 16 is attached under the ring groove 13*a*, and this sheet comprises a substance having a large friction coefficient with the positioning-mounting surface 15 of the sewing machine.

An operating member 17 has an extended operating portion 17*a*, whose bent portion 17*b* is attached with an element 18; member 17 is formed at its center with a hole 17*c* for passing the pin 14 of the base disc 13 therethrough and is formed with a plurality of holes 17*d* for holding a plurality of balls 19 (four balls in this instance) together with the groove 13*a* of the base disc 13, and is implanted with a pair of pins 17*e* having grooves 17*f* at their upper parts.

Figure 4:
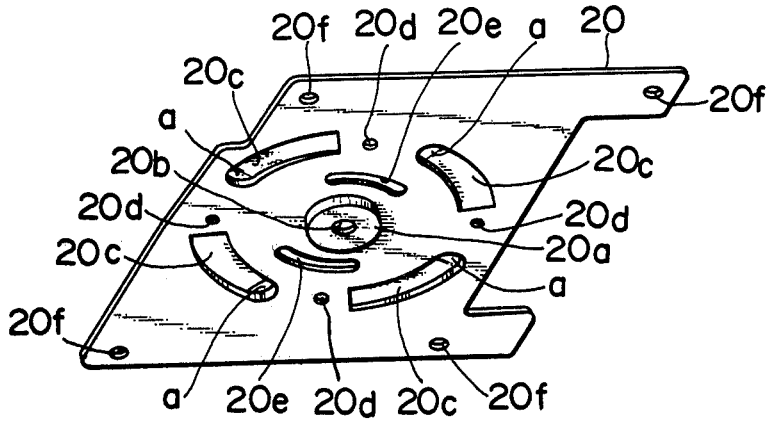
FIG. 4 is a view seen from arrow B in FIG. 3.

A reference will be made to a cam lift plate 20 in FIG. 4. The cam lift plate 20 is formed with a passing hole 20*b* at the center of a projection 20*a*, cam grooves 20*c* of the member corresponding to the number of the balls 19 engaging grooves 20*d* of the same number, a pair of guide grooves 20*e*, and holes 20*f* for a plurality of screws 21. A plurality of cam grooves 20*c* approximate a circle and become shallower in depth in the clockwise direction in FIG. 4. The cam lift plate 20 is fixed to the lower part of the machine body 1 by means of screws 21 (FIG. 2).

The pin 14 of the base disc 13 (FIG. 3) passes in order through the hole 17*c* of the operating member 17, a spring washer 22, a hole 20*b* of the cam lift plate 20, a compression coil spring 23 and a washer 24. The pin 14 is provided with a thrust stopper ring 25 located in the groove 14*a* thereof.

Figure 8:
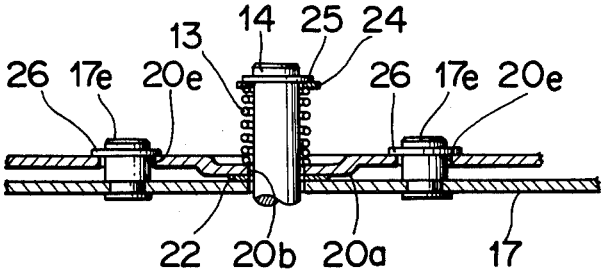
FIG. 8 is a vertical cross-sectional view showing relation between a cam lift plate and the operating member of the present device.
Figure 9:
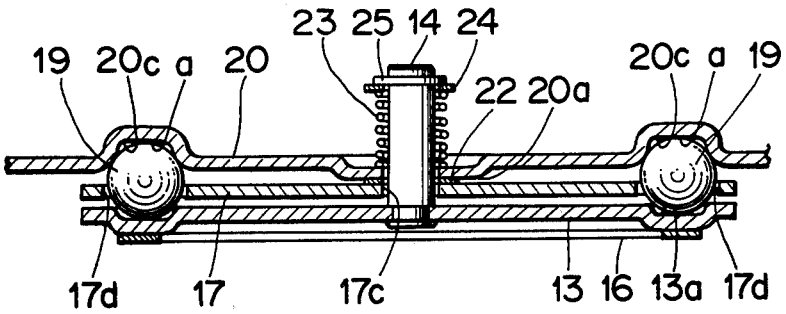
FIG. 9 is a vertical cross-sectional view of a main part of the present device, showing the operating member in the rest position.

The pins 17*e* of the operating member 17 pass through the grooves 20*e* of the cam lift plate 20, and then the pins 17*e* are fitted with C-rings 26 in the grooves 17*f* thereof and guided in the guide grooves 20*e* around the pin 14 so that pins 17*e* may rotate at determined angle in relation to the cam lift plate 20. With respect to the vertical movement, member 17 and plate 20 are made integral as shown in FIGS. 8 and 9, and are pushed down by the compression coil spring 23 via the washer 24, stopper ring 25 and the pin 14 such that they hold the balls 19 between the cam grooves 20*c* of the cam lift plate 20 and the groove 13*a* of the base disc 13.

Figure 5:
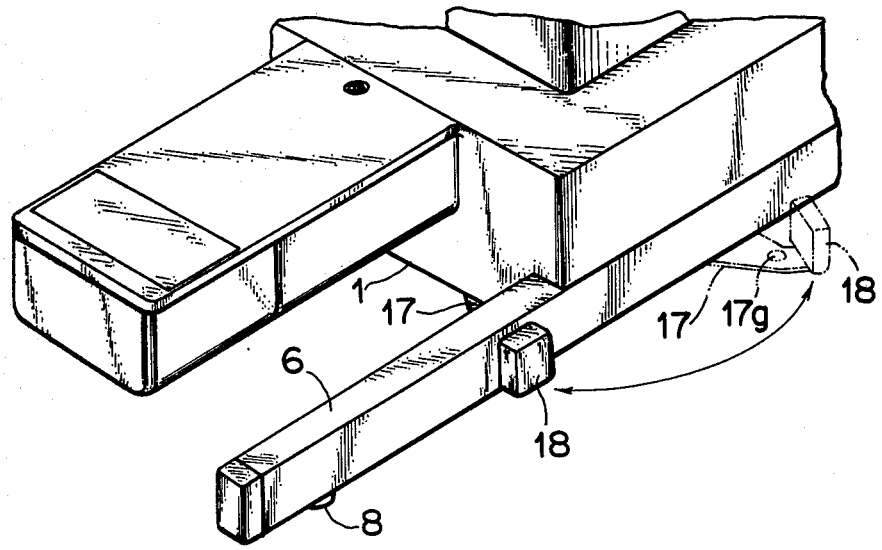
FIG. 5 is a perspective view showing a rest position and an operating position of the operating member in relation with the sewing machine.
Figure 11:
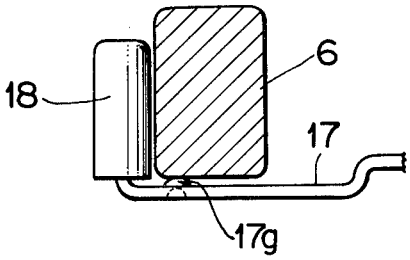
FIG. 11 is a vertical cross-sectional view showing a tubular base member in relation with the operating member.

The operating portion 17*a* of the operating member 17 is formed with a projection 17*g* as seen in FIGS. 5 and 11, and when the element 18 is turned to the rest position, illustrated with the solid line in FIG. 5, the projection 17*g* (FIG. 11) is pushed under the base tubular member 6 and the member 17 is engaged at the rest position, illustrated with the solid line, due to a friction force.

Since each ball 19 is kept between the cam groove 20*c* and the groove 13*a* by action of the compression coil spring 23 and the member 17 is located under the base tubular member 6 via the projection 17*g* in the rest position so that the member 17 is moved together with the machine body, the device of the present invention makes no noise during operation of the sewing machine.

Figure 6:
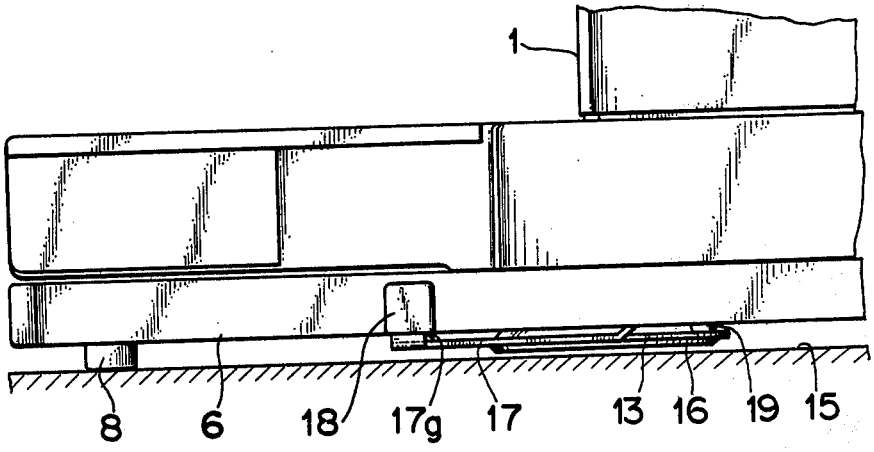
FIG. 6 is a view showing relation between the instant device, the sewing machine and the machine mounting surface in the rest position of the operating member.
Figure 10:
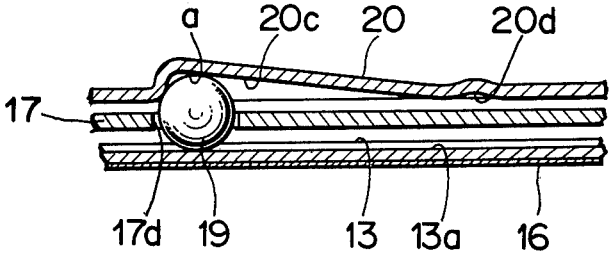
FIG. 10 is a partial vertical cross-sectional view of the main part of the device along a center line of a cam groove, showing the operating member in the rest position.

When the element 18 of the operating member 17 is at the rest position, illustrated with the solid line in FIG. 5, the ball 19 guided by the member 17 is positioned at the innermost part at a of the cam groove 20*c* (FIG. 10), and the sheet disc 16 provided on the lower surface of the base disc 13 is above the plain surface defined by the support feet 8, 9, 10 and 11 as shown in FIG. 6, from the machine mounting surface 15.

Figure 7:
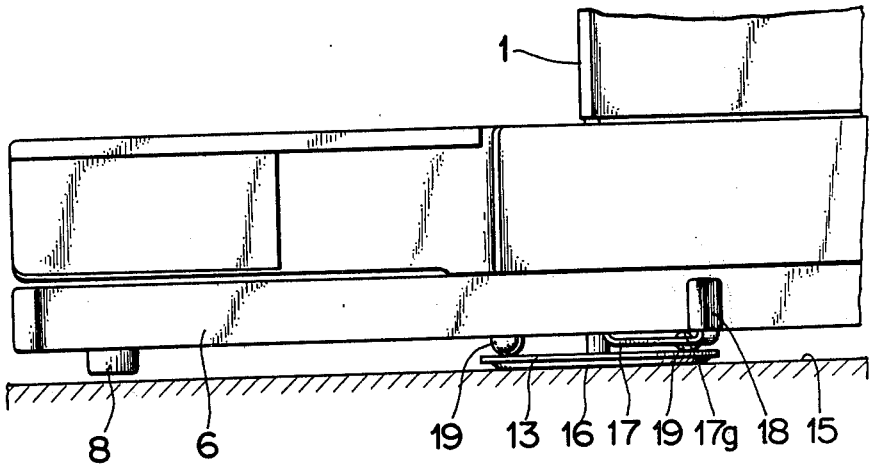
FIG. 7 is a view showing relation between the device, the sewing machine and the machine mounting surface in the operating position of the operating member.
Figure 13:
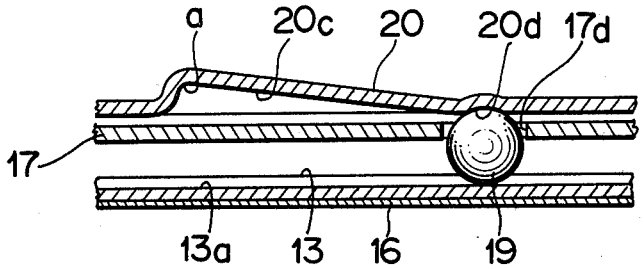
FIG. 13 is a vertical cross-sectional view of the main part of the device along the center line of the cam groove, showing the operating member in the operating position.

When the element 18 is rotated from the rest position, illustrated with the solid line in FIG. 5, to the operating position, illustrated with the dash-dotted line in the same, the ball 19 is moved, in the course of this rotation, from the innermost part a on the cam groove 20*c* to the shallower part of the groove, and the sheet disc 16 projects lower than said plain surface and contacts the machine mounting surface 15. When the operating member 17 is rotated under the condition that the machine body 1 is not rotated horizontally, the ball 19 engages in the groove 20*d* as shown in FIG. 13, and the machine body 1 contacts the surface 15 as shown in FIG. 7 only via the sheet disc 16.

Under this condition, the machine body 1 contacts the surface 15 via the balls 19 fitted in the ring groove 13*a* of the base disc 13 contacting the surface 15 via the sheet disc 16 and the engaging grooves 20*d* of the cam lift plate 20. If the machine body 1 is rotated horizontally, the balls 19 may rotate within the ring groove 13*a* of the base disc 13 under the condition that the balls 19 fit into the engaging grooves 20*d*, so that the machine body 1 may rotate by a slight force in relation to the surface 15.

Figure 12:
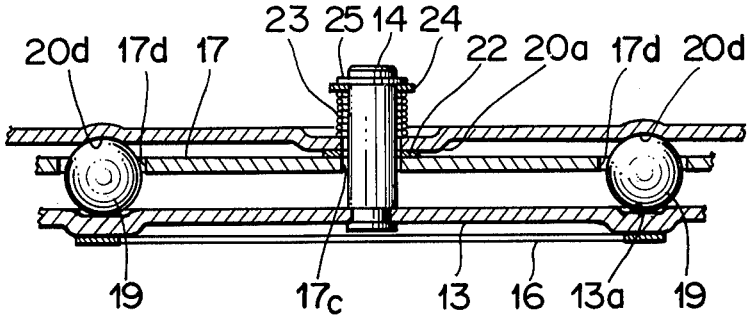
FIG. 12 is a vertical cross-sectional view of the main part of the device, showing the operating member in the operating position.

Operation of the present invention will be explained below. The stitch forming mechanism is rotated to the use position thereof by the following procedure. The machine body 1 is rotated from the rest position to the operating position by rotation of the element 18. During this rotation, the balls 19 are moved from the innermost part a of the cam grooves 20*c* of their shallower parts, and the sheet disc 16 on the lower surface of the base disc 13 projects down farther than the plain surface of the feet 8 to 11 and contacts the machine positioning surface 15. Subsequently, the feet 8 to 11 become separated from the machine mounting surface 15, and when the operating member 17 is rotated continuously toward the operating position, the balls 19 fit into the engaging grooves 20*d* in FIGS. 12 and 13. Thus, the machine body 1 may be rotated horizontally by a slight force.

Figure 14:
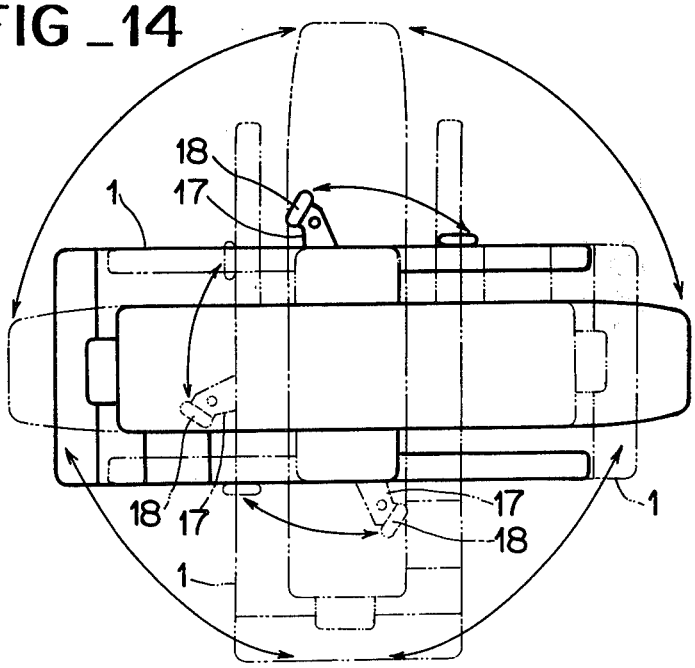
FIG. 14 is a schematic plan view explaining a horizontal switching rotation of the machine body.

With respect to switching of the sewing machine from the use position of the lock stitching mechanism to the use position of the overlock stitching mechanism, it should be noted that when the machine body 1 is rotated in the clockwise direction from the condition, shown in FIG. 14 by a dash-dotted line, to the condition, shown by the solid line, and the operating member 17 is returned from the condition shown in FIG. 5 by the dash-dotted line to the rest position, shown with the solid line, the sheet disc 16 moves upwards, and the machine body 1 contacts the machine mounting surface 15 below the feet 8 to 11.

The overlock stitch mechanism is switched to the lock stitch mechanism by rotating the machine body 1 from the condition shown in FIG. 14 by the solid line in the counter-clockwise direction, by returning the operating member 17 from the position, shown by the dash-dotted line, to the rest position, shown by the solid line, then by moving the sheet disc 16 upwards so that the machine body 1 will contact the machine mounting surface 15 below the feet 8 to 11.

Due to the present invention, the machine body may be lifted from the machine mounting surface by an external and slight force, whereby the machine body can be rotated horizontally, and subsequently the machine body may be moved down to the mounting surface. Thus, switching to the desired stitch forming mechanism may be easily and exactly executed.

What is claimed is:

1. In a double-function sewing machine having a machine body, lock stitching mechanism and an overlock stitching mechanism positioned at two opposite sides of the machine body, and feet positioned on a lower surface of the machine body and abutting against a machine mounting surface on which the machine is positioned, a switching device for switching the positions of the lock stitching mechanism and the overlock stitching mechanism comprising rotating switching means disposed on said lower surface of the machine body and including a rotatable operating member, a base disc operatively connected to said operating member and adapted to move in a vertical direction with respect to said lower surface upon rotation of said operating member between a rest position in which said base disc is above the machine mounting surface and an operating position in which said base disc projects downward farther than said feet to contact said machine mounting surface, whereby the machine body is lifted from the machine mounting surface and may be rotated in a horizontal plane to place a required one of said stitching mechanisms to a use position.

2. The sewing machine as defined in claim 1, wherein said switching means further include a cam lift plate connected to the lower surface of the machine body and formed with circumferentially extended cam grooves and a central hole, and cooperating with said operating member.

3. The sewing machine as defined in claim 2, wherein said base disc is formed with a circular groove, the switching means further including balls engaged in said circular groove and adapted to engage with said cam grooves of said cam lift plate when said base disc is in its rest position.

4. The sewing machine as defined in claim 3, said base disc having a pin outwardly projected therefrom toward said operating member, said operating member having a central hole, said pin passing through the central hole of the operating member and the central hole of the cam lift plate.

5. The sewing machine as defined in claim 4, wherein said operating member and said cam lift plate are biased by a compression spring mounted on said pin.

6. The sewing machine as defined in claim 5, wherein said cam lift plate is formed with engaging grooves in which said balls are engaged when said base disc is in its operating position.

7. The sewing machine as defined in claim 6, wherein said operating member includes a projection extended laterally outwardly from the lower surface of the machine body and terminated with an element to which an external force for rotating said operation member is applied.

* * * * *